US007625190B2

(12) United States Patent
Smith

(10) Patent No.: US 7,625,190 B2
(45) Date of Patent: Dec. 1, 2009

(54) CROSSOVER SWITCHING VALVE

(75) Inventor: Steve C. Smith, Trabuco Canyon, CA (US)

(73) Assignee: K.R. Anderson, Inc., Santa Ana, CA (US)

( * ) Notice: Subject to any disclaimer, the term of this patent is extended or adjusted under 35 U.S.C. 154(b) by 245 days.

(21) Appl. No.: 11/103,272

(22) Filed: Apr. 11, 2005

(65) Prior Publication Data

US 2005/0244281 A1 Nov. 3, 2005

Related U.S. Application Data

(60) Provisional application No. 60/562,040, filed on Apr. 14, 2004.

(51) Int. Cl.
*F04B 7/00* (2006.01)

(52) U.S. Cl. ..... 417/516; 417/297; 417/507; 417/572; 137/596.14

(58) Field of Classification Search ..... 417/297, 417/507, 516, 572; 137/596.14
See application file for complete search history.

(56) References Cited

U.S. PATENT DOCUMENTS 2,825,528 A * 3/1958 Truitt ..... 251/175
3,764,235 A 10/1973 Bittermann
3,781,141 A * 12/1973 Schall ..... 417/395
3,815,621 A 6/1974 Robinson
3,838,946 A 10/1974 Schall
3,912,127 A 10/1975 Georgi
4,161,136 A * 7/1979 Krieger ..... 91/461
4,309,152 A 1/1982 Hagen
4,354,806 A 10/1982 McMillin et al.
4,424,012 A * 1/1984 Westmoreland ..... 417/507
4,477,052 A * 10/1984 Knoblauch et al. ..... 251/57
4,720,246 A 1/1988 Morton
4,895,497 A 1/1990 Schlinkheider
4,981,418 A 1/1991 Kingsford et al.
5,404,767 A 4/1995 Sutherland (Continued)

OTHER PUBLICATIONS

U.S. Appl. No. 11/267,535, including file history.

*Primary Examiner*—Devon C Kramer
*Assistant Examiner*—Leonard J Weinstein
(74) *Attorney, Agent, or Firm*—Knobbe, Martens, Olson & Bear, LLP

(57) ABSTRACT

The present invention involves several different embodiments related to a crossover switching valve. The crossover switching valve is preferably designed to receive fluid from a reservoir, or other fluid source, and direct the inflow and outflow of the fluid between the valve and one or more pumps. In one embodiment, the valve is configured to provide a substantially continuous flow rate when used in connection with a double acting pump. In another embodiment, the valve preferably includes an inflow port, an outflow port, and first and second ports configured to be fluidly connected to at least one pump. Another embodiment of the present invention is a conduit that preferably provides fluid communication between the first and second ports. Yet another embodiment is a fluid director that is preferably configured to alter flow of fluid through the conduit. In some embodiments, the inflow port is in fluid communication with the first port while the outflow port is in fluid communication with the second port. In other embodiments, the inflow port is in fluid communication with the second port while the outflow port is in fluid communication with the first port. Also disclosed is a pumping system that incorporates the crossover switching valve and a pump.

4 Claims, 5 Drawing Sheets

U.S. PATENT DOCUMENTS

| | | | | |
|---|---|---|---|---|
| 5,746,831 | A * | 5/1998 | Allen et al. | 118/621 |
| 6,015,268 | A | 1/2000 | Hetherington | |
| 6,074,170 | A | 6/2000 | Bert | |
| 6,206,032 | B1 * | 3/2001 | Hill | 137/539.5 |
| 6,224,344 | B1 | 5/2001 | Hasbrouck | |
| 6,398,514 | B1 * | 6/2002 | Smith et al. | 417/120 |
| 6,874,997 | B2 | 4/2005 | Watanabe et al. | |
| 2006/0171827 | A1 | 8/2006 | Smith et al. | |

* cited by examiner

CROSSOVER SWITCHING VALVE

RELATED APPLICATION

This application claims priority pursuant to 35 U.S.C. § 119(e) to co-pending U.S. Provisional Patent Application Ser. No. 60/562,040, filed Apr. 14, 2004, which is hereby incorporated by reference in its entirety.

BACKGROUND OF THE INVENTION

1. Field of the Invention

This invention relates generally to fluid valves and particularly to those capable of providing fluid direction control and switching functions at a substantially continuous rate.

2. Description of the Related Art

In order to enhance performance of their pumping systems, many manufacturers have replaced single acting pumps with double acting pumps. These reciprocating pumps typically utilize one or more cylinders together with appropriate valves for controlling fluid flow to and from the cylinders. The pumps are configured to simultaneously pump fluid from one cylinder while drawing fluid into another cylinder. When the fluid of the pumping cylinder is expended, the pump switches the pumping action to the other cylinder, while supplying the expended cylinder with fluid. This reciprocating action permits the pump to have a relatively continuous flow.

The double acting pumps may be connected to a rotating crossover valve that switches the fluid flow by rotating a cylindrical fluid director to communicate with various ports on the pump. These crossover valves, however, are required to operate under low to medium pressure in most applications but also very high pressures in many applications. For example, some applications may require pressures in excess of 3,000 psi. Additionally, many of the fluids that are being pumped in such applications contain coarse particles, which can cause significant wear and tear on the valve leading to valve leakage and failure.

The rotating crossover valves have several problems when operating under such conditions. For example, one problem is that the coarse particles are often drawn into an area between the rotating fluid director and stationary valve housing and wear the fluid director and housing. As a result, the rotatable crossover valves are unable to operate for long periods of time and frequently require replacement, typically of the entire crossover valve.

SUMMARY OF THE INVENTION

There is need for a valve that can operate without the disadvantages of the rotatable crossover valves. Specifically, there is a need for a valve that can operate with various fluids under high or low pressure with increased longevity.

The present invention involves several different embodiments related to a crossover switching valve. The crossover switching valve is preferably designed to receive fluid from a reservoir and moderate the inflow and outflow of the fluid between the valve and the pump. The valve is preferably configured to provide a substantially continuous flow rate when used in connection with a double acting pump.

In one embodiment of the present invention, a valve is provided that is configured to provide substantially continuous flow, fluid direction control, and switching functions. The valve preferably includes an inflow port that is configured to permit fluid to flow into the valve from a fluid reservoir and an outflow port that is configured to discharge fluid from the valve. The valve may also preferably include a first port that is configured to be in fluid communication with a first portion of a dual acting pump and a second port that is configured to be in fluid communication with a second portion of the dual acting pump. The valve preferably includes an internal conduit that is configured to provide fluid communication between the inflow port, the outflow port, the first port, and the second port. Also preferably included are first and second occluders, the first and second occluders are preferably configured to have first and second positions. The valve also preferably includes first and second actuators, the first actuator is preferably configured to linearly translate the first occluder between the first and second positions, and the second actuator is preferably configured to linearly translate the second occluder between the first and second positions. In operation, the valve is preferably configured such that when the first and second occluders are in the first position, the inflow port is preferably in fluid communication with the first portion of the dual acting pump, and the outflow port is preferably in fluid communication with the second portion of the dual acting pump. The valve is also preferably configured such that when the first and second occluders are in the second position, the inflow port is preferably in fluid communication with the second portion of the dual acting pump, and the outflow port is in fluid communication with the first portion of the dual acting pump.

In another embodiment, a continuous flow valve is provided that preferably includes an inflow port that is preferably configured to connect to a reservoir and an outflow port that is preferably configured to discharge fluid from the valve. The valve may preferably include first and second ports that are preferably configured to be in fluid communication with at least one pump. The valve also preferably includes a conduit that interconnects the inflow port, the outflow port, the first port, and the second port. The valve may also preferably include an occluder configured to have a first and second position. When the occluder is in the first position, the occluder is preferably configured to separate the conduit into a first configuration consisting of two portions. The first portion preferably permits fluid communication between the inflow port and the first port, and the second portion preferably permits fluid communication between the outflow port and the second port. In the second position, the occluder is preferably configured to separate the conduit into a second configuration of two portions. The first portion of the second configuration preferably permits fluid communication between the inflow port and the second port, and the second portion of the second set preferably permits fluid communication between the outflow port and the first port.

In yet another embodiment, the valve may include a flow director that is configured to direct fluid flow between the inflow and first port and between the outflow and second port in one position. In another position, the flow director may be configured to direct fluid flow between the inflow and second port and between the outflow and first port. In other embodiments, a system is provided in which the valve is connected to a pump.

For purposes of summarizing the invention, certain embodiments, advantages, and novel features of the invention have been described herein. Of course, it is to be understood that not necessarily all such embodiments, advantages, or features are required in any particular embodiment of the invention.

BRIEF DESCRIPTION OF THE DRAWINGS

The features of the present invention, which are believed to be novel, are set forth with particularity in the claims. The invention, together with further objects and advantages thereof, may best be understood by making reference to the following description taken in conjunction with the accompanying drawings, in the figures of which like referenced numerals identify the like elements, and wherein:

DETAILED DESCRIPTION OF THE PREFERRED EMBODIMENTS

Figure 1:
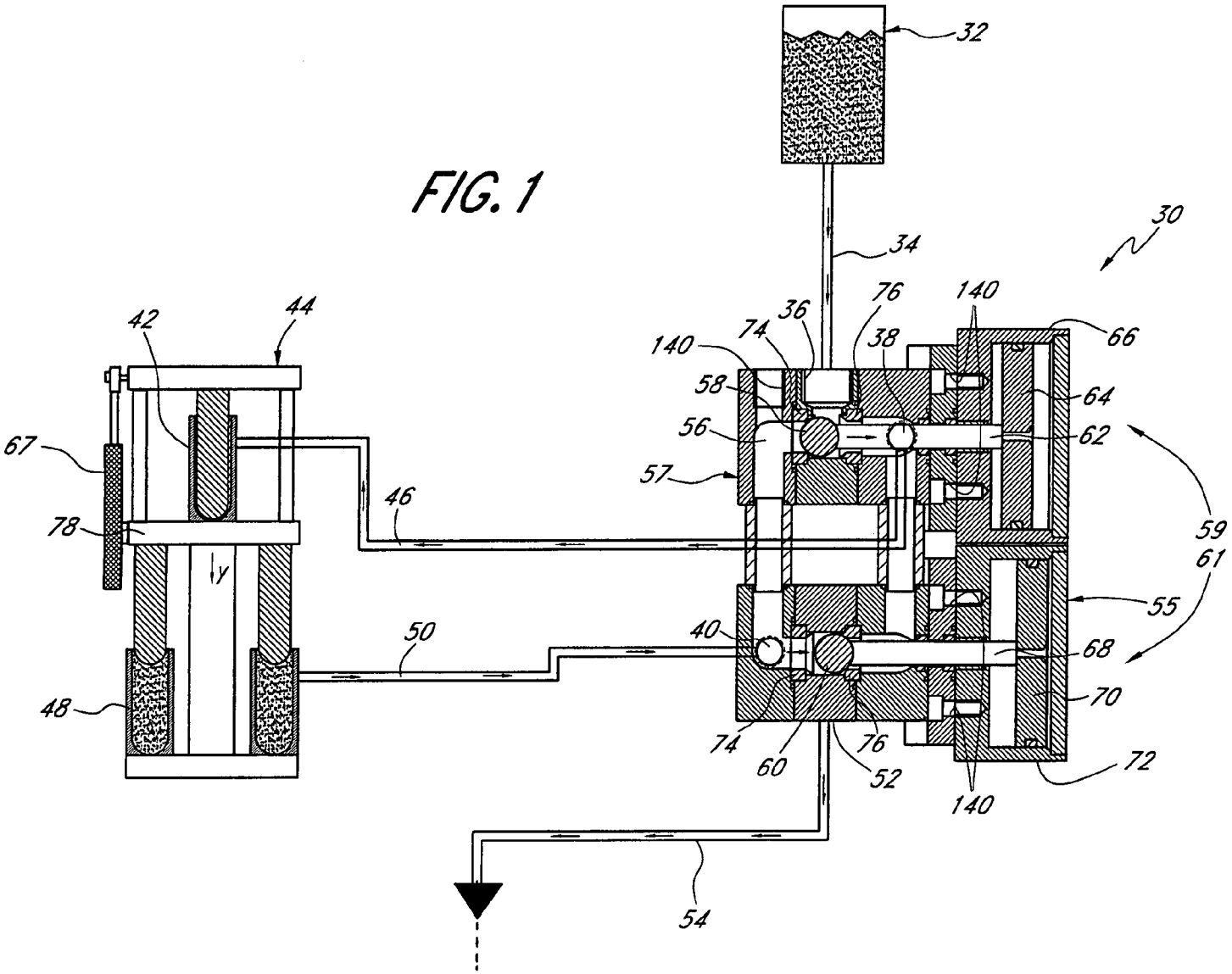
FIG. 1 is a schematic view of a crossover switching valve connected to a pumping system including a fluid reservoir, a pump, and an outflow line, the flow of the fluid and direction of the pump are shown by arrows.

FIG. 1 illustrates a schematic drawing of a pumping system in which a crossover switching valve 30 is used. The crossover switching valve 30 is preferably in fluid communication with a fluid reservoir 32 by an inflow line 34, one example of which would be tubing. The inflow line 34 is preferably coupled to the crossover switching valve 30 by an inflow port 36. The crossover switching valve 30 includes a first pump port 38 and a second pump port 40. The first pump port 38 is preferably in fluid communication with a top pump cylinder 42 of a double acting pump 44 by a first pump line 46. One example of a double acting pump 44 is provided in U.S. Pat. No. 6,398,514 to Smith et al., the entirety of which is incorporated herein by reference. The second pump port 40 is preferably in fluid communication with a bottom pump cylinder 48 by a second pump line 50.

The crossover switching valve 30 also preferably includes an outflow port 52 that is coupled to an outflow line 54. The inflow port 36, first pump port 38, second pump port 40, and outflow port 52 are preferably fluidly connected by an internal conduit 56. The continuous flow valve 30 preferably includes a base 55, a top 57, an inflow portion 59, and an outflow portion 61. The designations top, base, inflow, or outflow, etc. are used herein only for descriptive purposes and are not intended to indicate any particular orientation or configuration of the continuous flow valve 30.

Preferably, the crossover switching valve 30 also includes an inflow occluder 58 and outflow occluder 60, as shown in FIG. 1. The inflow occluder 58 is preferably coupled to a first end of a rod 62. A piston 64 is preferably coupled to the second end of the rod 62, the piston 64 being housed within a first cylinder 66. Preferably, movement of the piston 64 within the first cylinder 66 translates through the rod 62 to movement of the inflow occluder 58 within the internal conduit 56.

A similar configuration is illustrated with respect to the outflow occluder 60 in FIG. 1. The outflow occluder 60 may be coupled to a first end of a rod 68, and a second end of the rod 68 may be coupled to a piston 70. The piston 70 is movable within a second cylinder 72 such that movement of the piston 70 is translated through rod 68 to movement of the outflow occluder 60 within the internal conduit 56. When the piston 64, 70 rises to the top of the cylinder 66, 72, the respective occluder 58, 60 preferably engages a top seat 74, as is shown with respect to the inflow occluder 58 of FIG. 1. When a piston 64, 70 is lowered to the bottom of the cylinder 66, 72, the respective occluder 58, 60 preferably engages a bottom seat 76, as is shown with respect to the outflow occluder 60 of FIG. 1.

With continued reference to FIG. 1, the occluders 58, 60 preferably have a generally spherical shape. While the occluders 58, 60 are illustrated as spheres, they may consist of several other shapes. For example, the occluders 58, 60 may be conical, ovoid, etc. Other shapes for the occluders 58, 60 may also be used.

The occluders 58, 60 may be made from any number of materials. Preferably, the occluders 58, 60 are made of stainless steel. The occluders 58, 60 may also include a hardened surface, e.g., made of tungsten carbide, hard chrome, etc. The occluders 58, 60 may also be made of other materials such as other carbon steels, ceramics, and plastics, for example. The occluders 58, 60 may be threadably connectable to the rod 62, 68 by having an internal threaded bore that couples with a threaded first end of the rod 62, 68. Other ways of coupling the occluders 58, 60 to the rod 62, 68 may also be used. For example, the occluders 58, 60 may be integrally formed with the rod 62, 68, bonded to the rod 62, 68, etc.

In one embodiment, the occluders 58, 60 are substantially a spherical shape with a diameter of about 0.625 inches. In other embodiments, the diameter of the occluders 58, 60 may vary from about 0.4 inches to 0.8 inches. In yet other embodiments, the diameter of the occluders 58, 60 may be substantially greater than about 0.8 inches and less than about 0.4 inches.

Figure 4A:
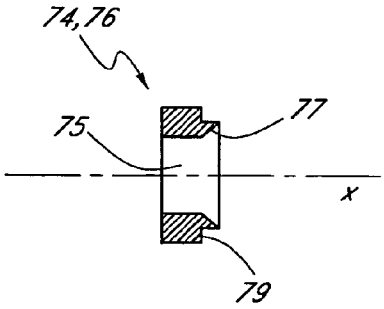
FIG. 4A is a cross-sectional view of a seat against which an occluder may be engaged.
Figure 4B:
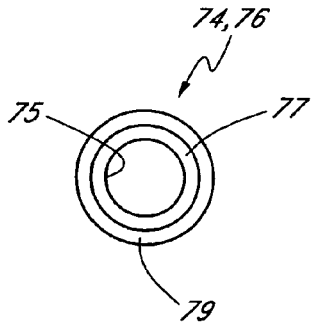
FIG. 4B is a top view of the seat of FIG. 4A.

The seats 74, 76 preferably have a cylindrical shape with a hollowed portion 75 to permit passage of fluid and the rod 62 therethrough, as shown in FIGS. 4A and 4B. The hollowed portion 75 within the cylinder of the seat 74, 76 preferably includes a portion 77 that is angled axially outward such that the diameter of the hollowed portion 75 increases along a longitudinal axis X of the seat 74, 76. In one embodiment, the seat 74, 76 generally comprises a cylindrical shape, and the axis X is defined by the axis of the cylinder. Thus, the angled portion 77 is preferably configured to accommodate the occluder such that sealing of the passageway through the seats 74, 76 may occur. The seats 74, 76 also preferably include a step 79 that is configured to secure the seats 74, 76 in place when assembled. Other ways of securing the seats 74, 76 may also be used.

While they are illustrated as cylindrical, the seats 74, 76 may be constructed in any shape that will accommodate the occluder and provide sealing of the passageway. Additionally, although the surface of the angled portion 77 illustrated is substantially straight, the surface of the angled portion 77 may be convex, concave, or other shapes. The seats 74, 76 are preferably machined from polyethylene, although they may be formed in other ways and consist of other materials. For example, the seats 74, 76 could be injection molded, cast, formed, etc., and the seats 74, 76 may be made from other plastics, metals, composites, etc.

The hollowed portion 75 of the seats 74, 76 is preferably about 0.5 inches in diameter. In other embodiments, the hollowed center may range from about 0.3 to about 0.7 inches in diameter. In yet further embodiments, the hollowed portion 75 may be significantly greater than about 0.7 inches or less than about 0.3 inches in diameter.

In some embodiments, the occluders 58, 60 and the seats 74, 76 may be configured in the valve 30 such that replacement thereof requires minimal time and expense. For example, in one embodiment, the occluders 58, 60 may be threadingly coupled to the rods 62, 68 such that replacement thereof may be easily made upon disassembly. In some embodiments, other means of coupling may be used to facilitate timely and inexpensive replacement. In some embodiment, the seats 74, 76 may also be configured to be easily replaced upon disassembly of the valve 30.

The double acting pump may operate in two stages. During the first stage, a carriage 78 of the double acting pump 44 moves down as indicated by the arrow Y. While the carriage 78 is moving down, fluid may be supplied to the top pump cylinders 42. While FIG. 1 appears to show one top cylinder 42, in the illustrated embodiment, another cylinder 42 is located behind the one shown. Hence, the pump may have one or more top pump cylinders 42 and one or more bottom pump cylinders 48. While the carriage 78 is moving down, fluid may be pumped from the bottom pump cylinders 48 through the second line 50. During this stage, the inflow occluder 58 engages the seat 74 while the outflow occluder 60 engages the seat 76. Thus, fluid supplied to the inflow port 36 is directed to the first pump port 38. This fluid is then supplied to the top pump cylinder 42 through the first pump line 46. In this same configuration, fluid is pumped from the bottom pump cylinder 48 through the second pump line 50 and into the second pump port 40. Upon entering the second pump port 40, the fluid is directed through the outflow port 52 to the outflow line 54.

Figure 2:
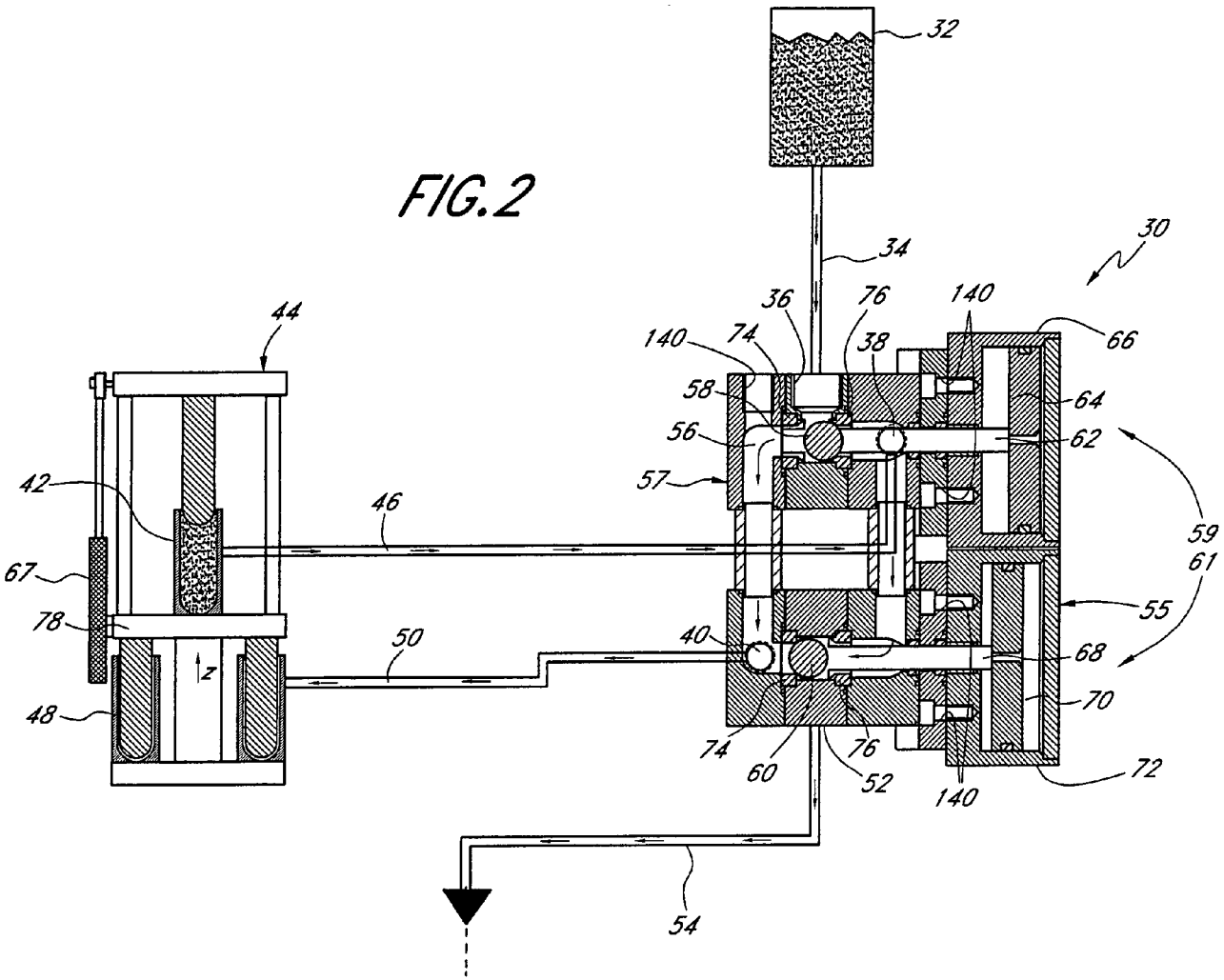
FIG. 2 is a schematic view of a crossover switching valve connected to a pumping system, the flow of fluid and direction of the pump are shown by arrows.

In a second stage of the operation of the pump 44, the carriage 78 of the double acting pump 44 is moving up, as indicated in FIG. 2 by the arrow Z. During this stage, fluid is pumped from the top pump cylinder 42 to the first pump port 38, and fluid is supplied to the bottom pump cylinders 48 through the second pump port 40. Preferably, the piston 64 is shown at or near the bottom of the first cylinder 66 such that the inflow occluder 58 engages the bottom seat 76. In this configuration, the occluder 58 and the seat 76 seal the connection between the inflow port 36 and the first pump port 38 and permit fluid communication between the inflow port 36 and the second pump port 40. In this embodiment, the piston 70 is preferably at or near the top of the second cylinder 72 such that the outflow occluder 60 engages the top seat 74. Accordingly, the occluder 60 and the seat 74 seal the connection between the outflow port 52 and the second pump port 40 and permit fluid communication between the outflow port 52 and the first pump port 38.

In one embodiment, and as illustrated in FIG. 2, fluid supplied into the inflow port 36 is directed through the internal conduit 56 to the second pump port 40. The fluid is transferred to the bottom pump cylinder 48 through the second pump line 50. Fluid from the top pump cylinder 42 is supplied to the first pump port 38 by the first pump line 46. Upon entering the first pump port 38, the fluid is directed through the internal conduit 56 to the outflow port 52 and is thereupon discharged through the outflow line 54.

The outflow line 54 may be directly connected to the output instrument (not shown), if desired. In some embodiments, it may be desirable to combine the outflow line 54 of multiple valves 30, such as may be the case in supplying a resin and catalyst, for example. In these embodiments, the outflow line 54 of the various valves 30 may be connected to a manifold (not shown) that combines the output of the valves 30. The manifold preferably may combine the fluids and direct the fluids through a tube that provides stationary mixers, such that the fluids may be mixed into a homogenous blend. Upon leaving the tube, the homogenous fluid may be supplied to an output instrument.

While FIGS. 1 and 2 show different stages of a certain embodiments of the crossover switching valve 30, it will be readily apparent to one of ordinary skill in the art that alternative configurations may be used to accomplish the same objectives. For example, the first pump port 38 and the first pump line 46 may be coupled with the bottom pump cylinders 48 instead of the top cylinder 42, and the second pump port 40 and the second pump line 50 may be coupled to the top cylinder 42 instead of the bottom pump cylinder 48. Additionally, FIG. 1 and the related description of FIG. 1 shows the top pump section as having one cylinder set behind another cylinder while the bottom pump section is shown in FIGS. 1 and 2 as having two cylinders set apart. However, one or more cylinders may be used in the double acting pump 44, and the cylinders 42, 48 may have various configurations. For example, the top and bottom pump sections of the double acting pump may have one cylinder, two cylinders, three cylinders, etc. Further details about one exemplary pump that may be used are found in U.S. Pat. No. 6,398,514 to Smith et al., previously incorporated by reference. In other embodiments, the valve 30 may have multiple pump ports 38, 40 and multiple pump lines 46, 50. In further embodiments, the valve 30 may be connected to various pumps.

The double acting pump 44 is preferably configured to supply a substantially continuous flow rate through the first pump line 46 and second pump line 50 by its reciprocating action. The double acting pump 44 and its computer controller preferably control actuation of the pistons 64, 68 of the crossover switching valve 30. In a preferred embodiment, a servo motor (not shown) of the double acting pump 44 may be connected to an air compressor (also not shown) that controls the pressure difference across the pistons 64, 68. In another embodiment, a linear transducer 67 may control the signal. The orientation of the pistons 64, 68 may also be changed by air solenoid valves, electronic solenoids, hydraulics, mechanics or other means that are apparent to those of ordinary skill in the art. The orientation of the pistons 64, 68 preferably switches with the change in direction of the carriage 78 of the double acting pump 44 to provide a continuous flow rate through the valve 30.

The crossover switching valve 30 may consist of four general segments: a top 57 inflow 59 portion, a base 55 inflow 59 portion, a top 57 outflow 61 portion, and a base 55 outflow 61 portion. The top 57 inflow 59 portion may include a top inflow section 80, an inflow section 82, and an intermediate inflow section 84. Likewise, the top 57 outflow 61 portion may include a top outflow section 86, an outflow section 88, and an intermediate outflow section 90. The base 55 inflow 59 portion may comprise an inflow portion spacer 92 and an inflow portion cylinder 94. The base 55 outflow 61 portion may include an outflow portion spacer 96 and an outflow portion cylinder 98. The top inflow section 80, inflow section 82, intermediate inflow section 84, top outflow section 86, outflow section 88, and intermediate outflow section 90 preferably include bores or passageways that are configured to provide fluid communication therethrough and create the internal conduit 56. The various portions, their features, and operations will be described below.

In some embodiments, portions of the valve 30 may be combined in the manufacturing process. For example, although the Figures illustrate embodiments in which the top 57 inflow 59 portion is made of three discrete sections, two or more of these sections may be combined such that the top 57 inflow 59 portion is constructed of only one or two pieces. In yet other embodiments, the portions of the valve 30 may include other sections than those previously identified.

The various portions of the crossover switching valve 30 are preferably machined from aluminum or other appropriate metals. The various portions of the flow valve may also be made from other materials such as ceramics and plastics, for example. In some embodiments, the portions of the valve may be formed, cast, molded or other appropriate manufacturing methods may be used.

Figure 3:
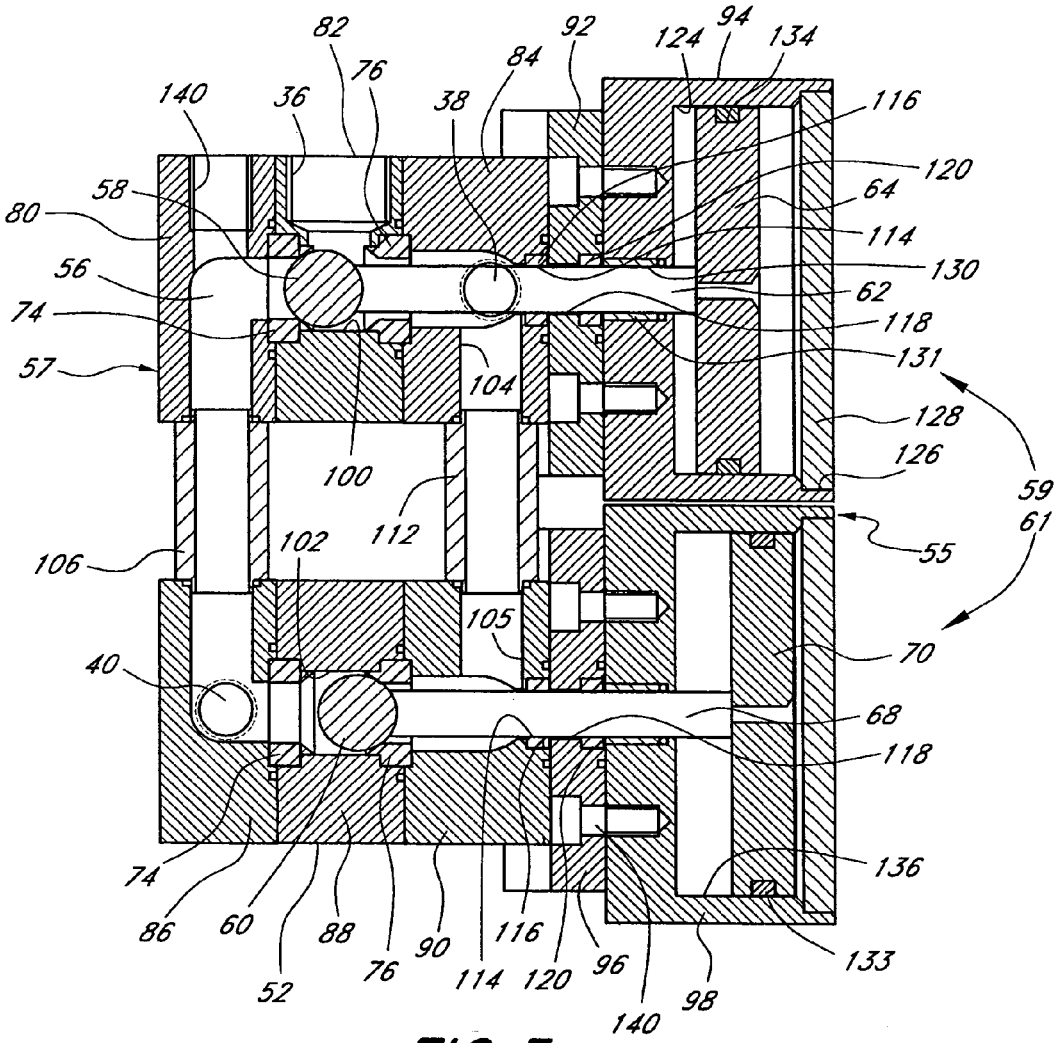
FIG. 3 is a cross-sectional view of one embodiment of the crossover switching valve.

As shown in FIG. 3, the inflow section 82 and the outflow section 88 are preferably positioned between their respective top section 80, 86 and intermediate section 84, 90. As shown in FIG. 3, a passageway 100 that is substantially axially aligned with the rod 62 preferably extends from the top of the inflow section 82 to its base. The inflow port 36 preferably extends from an exterior of the inflow section 82 to the passageway 100, providing fluid communication between the inflow port 36 and the passageway 100. In one embodiment, the connection of the inflow port 36 and passageway 100 may form a T-shaped conduit, as shown in FIG. 3, with respect to the inflow section 82.

The passageway 100 preferably has a diameter sufficient to accommodate the inflow occluder 58 such that the inflow occluder 58 is moveable within the passageway 100. The inflow occluder 58 is preferably positioned so that it may engage the top seat 74 and the bottom seat 76 within the passageway 100.

In one embodiment, the passageway 100 may have a diameter of about 0.688 inches. In other embodiments, the passageway 100 may have a diameter between about 0.4 inches to about 0.8 inches. In yet other embodiments, the passageway 100 may have a diameter substantially less than about 0.4 inches and greater than about 0.8 inches.

In one embodiment, the inflow port 36 may have a diameter of about 0.5 inches. In other embodiments, the inflow port 36 may have a diameter between about 0.3 inches and about 0.8 inches. In yet other embodiments, the inflow port 36 may have a diameter substantially less than about 0.3 inches and greater than about 0.8 inches.

The passageway 100 may have a bore on the top and bottom side configured to accommodate placement of the seats 74, 76 therein, engaging the step 79 of the seats 74, 76. In one embodiment, the bores may have a diameter of about 0.876 inches. In other embodiments, the bores may have a diameter between about 0.5 inches and about one inch. In yet other embodiments, the bores may have a diameter that is substantially greater than about one inch and less that about 0.5 inches.

With continued reference to FIG. 3, the outflow section 88 may have a similar configuration as the inflow section 82. Preferably, a passageway 102 extends from the top to the base side of the outflow section 88 that is substantially axially aligned with the rod 68. The passageway 102 is also preferably configured to accommodate a top seat 74 and a bottom seat 76 such that the outflow occluder 60 may engage either seat 74, 76 and is moveable between the two seats 74, 76. The passageway 102 preferably has a diameter sufficient to accommodate the outflow occluder 60 such that the outflow occluder 60 is moveable within the passageway 102.

The outflow port 52 preferably extends from an exterior of the outflow section 88 to the passageway 102, providing fluid communication between the exterior side and the bore. The outflow port 52 is preferably configured to permit coupling with an outflow line 54. In one embodiment, the outflow port 52 and respective passageway 102 may form a T-shaped conduit, similar to one embodiment of the inflow portion 82. In one embodiment, the outflow section 88 may be sized with similar dimensions and features as the inflow section 82 as described above.

As illustrated in FIG. 3, in one embodiment, the inflow section 82 and the outflow section 88 are separate pieces from the respective top sections 80, 86 and intermediate sections 84, 90. In this embodiment, the sections 82, 88 may be configured to be rotatable about the axis of the respective rod 62, 68. This may permit various orientations of the inflow and outflow ports 36, 52 and may permit interchangeability between the sections 82, 88. In some embodiments, the exterior portion of the sections 82, 88 may provide etchings or markings that correlate with the appropriate alignment and orientation desired. For example, if the sections 82, 88 are configured to be interchangeable, an exterior side of the sections 82, 88 may be marked for a desired alignment with the top and intermediate sections 80, 84 on the inflow portion 59. A different side of the sections 82, 88 may be marked for a desired alignment with the top and intermediate sections 86, 90 on the outflow portion 61.

The top inflow section 80 and top outflow section 86 are both preferably configured with a passageway extending from the base that is connectable to the respective passageway 100, 102 extending through the inflow section 82 and outflow section 88. The passageway in the top inflow section 80 is preferably shaped to direct fluid flow toward the top outflow portion 86. As shown in FIG. 3, the passageway may form a right angle, a circular arch, or other means to direct fluid towards the outflow portion 61.

The passageway within the top outflow section 86 preferably includes a passageway that is configured to receive the fluid from the top inflow section 80 and direct the fluid towards the passageway of the outflow section 88. This passageway may comprise a right angle as shown in FIG. 3, a circular arch, or other means that may appropriately direct the fluid flow. In the illustrated embodiment of FIG. 3, a top coupler 106 may be provided to connect the passageways of the top inflow section 80 and the top outflow section 86.

In some embodiments, the top inflow section 80 and the top outflow section 86 may be directly connected or formed together such that a top coupler 106 is not necessary. In one embodiment, the passageways of the top sections 80, 88 have a diameter of about 0.5 inches. In other embodiments, the diameter may be between about 0.3 inches and about 0.8 inches. In yet other embodiments, the diameter may be substantially less than about 0.3 inches and greater than about 0.8 inches.

Continuing reference to FIG. 3, the top outflow section 86 preferably includes the second pump port 40. The second pump port 40 may comprise a bore extending from an exterior side of the section 86 that fluidly communicates with the passageway of the top outflow section 86. The second pump port 40 may have a diameter that is about 0.5 inches in one embodiment. In other embodiments, the second pump port 40 diameter may be between about 0.3 inches and about 0.8 inches. In yet other embodiments, the second pump port 40 may have a diameter that is substantially less than about 0.3 inches and greater than about 0.8 inches.

While FIGS. 1-3 illustrate the second pump port 40 as being located on the top outflow section 88, the second pump port 40 may be located elsewhere between the two occluders 58, 60. For example, the second pump port 40 may be located on the top inflow section 80 or the on the top coupler 106.

The intermediate inflow section 88 preferably includes a passageway 104 that is configured to fluidly communicate with the passageway 100 of the inflow section 82. The passageway 104 of intermediate inflow section 84 is preferably configured to direct fluid from the inflow section 82 toward the intermediate outflow section 90. As shown in FIG. 3, the passageway 104 of the intermediate inflow section 84 may be configured at a right angle, a circular arch, or by other means that will direct the fluid flow toward the intermediate outflow section 90. In some embodiments, the passageway 104 may be substantially the same size as that of the passageways of the top sections 80, 86, having the same dimensions. In other embodiments, the passageway 104 may be a different size that that of the top section 80, 86 passageways.

The passageway 104 of the intermediate inflow section 84 also preferably fluidly communicates with the first pump port 38. The first pump port 38 is preferably configured to provide fluid communication between the exterior of the intermediate inflow section 84 and the internal conduit 56.

The intermediate outflow section 90 is preferably configured with a passageway 105 that fluidly communicates with the passageway 102 of the outflow section 88. The passageway 105 of the intermediate outflow section 90 is preferably configured to receive fluid from the intermediate inflow section 84 and direct the fluid to the outflow section 88. This may be accomplished by the passageway 105 being configured in a right angle as shown in FIG. 3, by a circular arch, or by other means that will direct the fluid flow. A base coupler 112 may be provided to fluidly connect the passageways 104, 105 of the intermediate inflow section 84 and the intermediate outflow section 90. In some embodiments, the intermediate inflow section 84 and the intermediate outflow section 90 may be directly connected or formed together such that the bottom coupler 112 is not necessary.

While FIG. 3 illustrates the first pump port 38 located on the intermediate inflow section 84, one of ordinary skill in the art will appreciate that the first pump port 38 may be placed at any location between the two occluders 58, 60. For example, as illustrated, the first pump port 38 may be located on the intermediate flow section 84, or the first pump port 38 may be located on the intermediate outflow section 90 or the base coupler 112.

The intermediate inflow section 84 preferably includes an aperture 114 on the base of the section 84 that is substantially the same diameter as the rod 62 and is axially aligned therewith, as illustrated in FIG. 3. The aperture 114 preferably extends from the base of the intermediate inflow section 84 to the internal conduit 56. This aperture 114 is configured to receive the rod 62 therethrough. The aperture 114 also preferably is configured to accommodate a primary seal 116 that prevents leakage of fluid within the internal conduit 56.

In one embodiment, the aperture 114 may have a diameter of about 0.39 inches. In other embodiments, the aperture 114 may have a diameter between about 0.3 inches and about 0.7 inches. In yet other embodiments, the aperture 114 may have a diameter significantly less than about 0.3 inches and greater than about 0.7 inches.

The intermediate outflow section 90 also preferably includes an aperture 114 that extends from the base of the section 90 to the internal conduit 56. The aperture 114 is preferably substantially the same diameter as the rod 68 and is axially aligned therewith. The aperture 114 is preferably configured to accommodate the rod 68 and a primary seal 116 that prevents leakage from the internal conduit 56. The aperture 114 of the intermediate outflow section 90 may have substantially the same diameter as that of the aperture 114 of the intermediate inflow section 84. In other embodiments, the aperture 114 of the intermediate outflow section 90 may have a different diameter than that of the intermediate inflow section 84.

The inflow portion spacer 92 also preferably has an opening 118 that aligns with the aperture 114 to accommodate the rod 62 extending therethrough. The opening 118 preferably accommodates a secondary seal 120 that prevents leakage from entering within the inflow portion cylinder 94 in the event that fluid leaks through the primary seal 116.

The outflow portion spacer 96 also preferably includes an opening 118 that is configured to align with the aperture 114 of the intermediate outflow section 90 to accommodate the rod 68 extending therethrough. The opening 118 is preferably configured to accommodate a secondary seal 120 to prevent fluid from entering into the outflow portion cylinder 98 in the event that fluid leaks past the primary seal 116.

The opening 118 through the inflow and outflow portion spacers 92, 96 may have a diameter of about 0.39 inches. In some embodiments, the diameter may be between about 0.3 inches and about 0.7 inches. In other embodiments, the diameter may be significantly less than about 0.3 inches and greater than about 0.7 inches. In some embodiments, the diameter of the inflow and outflow portion spacer 92, 96 opening 118 may be the same. In other embodiments, the diameter may differ between the inflow and outflow portion spacers 92, 96.

Figure 5B:
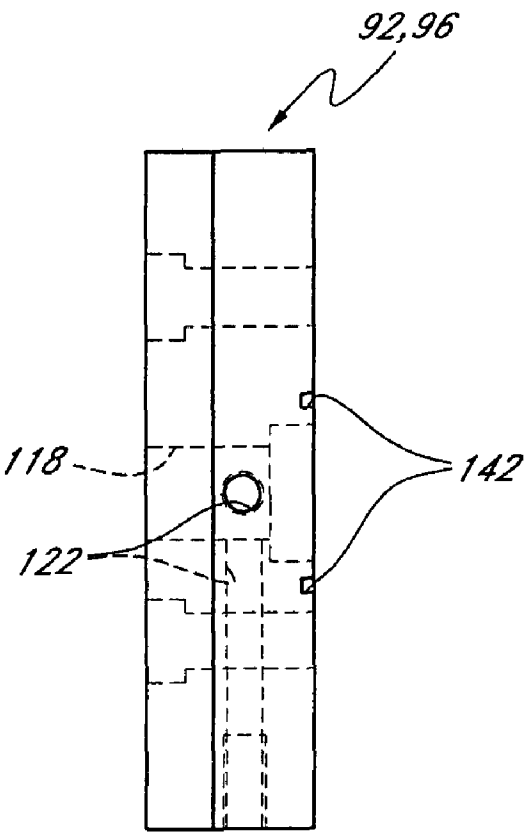
FIG. 5B is a side view of the spacer of FIG. 5A, a bleed hole and the middle bore of FIG. 5A shown in dashed lines.
Figure 5A:
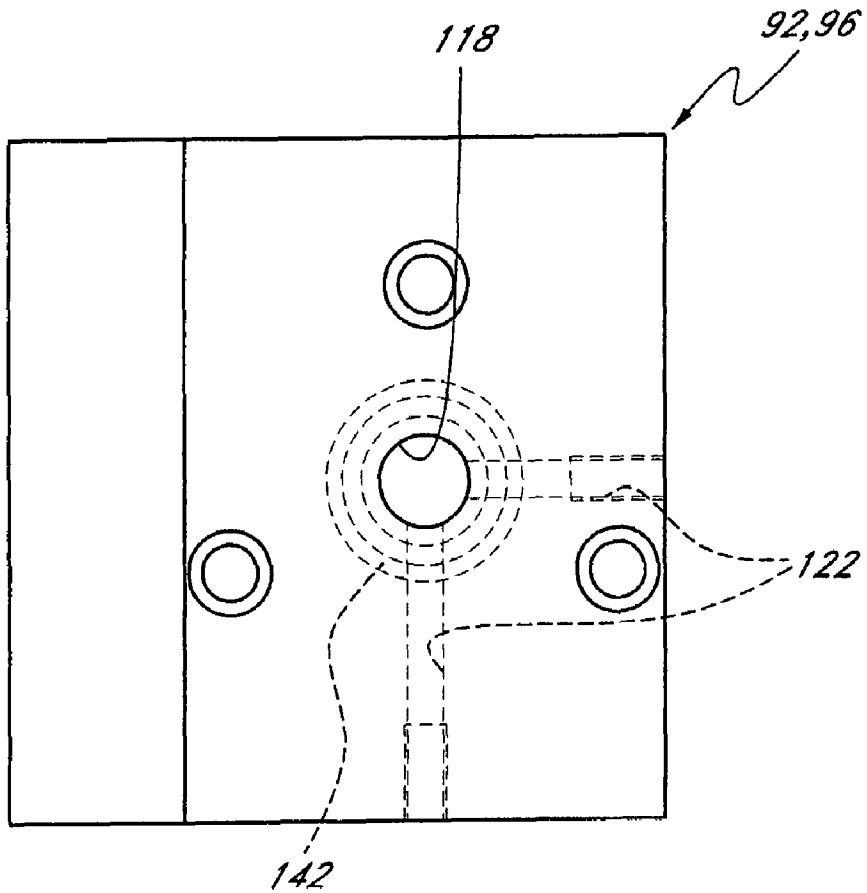
FIG. 5A is a top view of a spacer with bleed holes shown in dashed lines that extend from a bore in the middle of the spacer to an exterior side of the spacer.

As shown in FIGS. 5A and 5B, at least one channel 122 is preferably located in the inflow and outflow portion spacers 92, 96 between the location providing for the primary seal 116 and the secondary seal 120. The channel 122 preferably extends from the opening 118 to an exterior portion of the valve. The channel 122 is preferably configured to permit fluid to flow from the opening 118 to the exterior surface in the event that fluid penetrates the primary seal 116. Fluid flowing through the channel 122 will provide a visual indication that the primary seal 116 requires replacement. Preferably, the channel 122 is provided on both the inflow portion 59 and the outflow portion 61 with respect to the corresponding rod 62, 68. As shown in FIGS. 5A and 5B, the inflow and outflow portion spacers 92, 96 may include more than one channel 122.

Figure 6B:
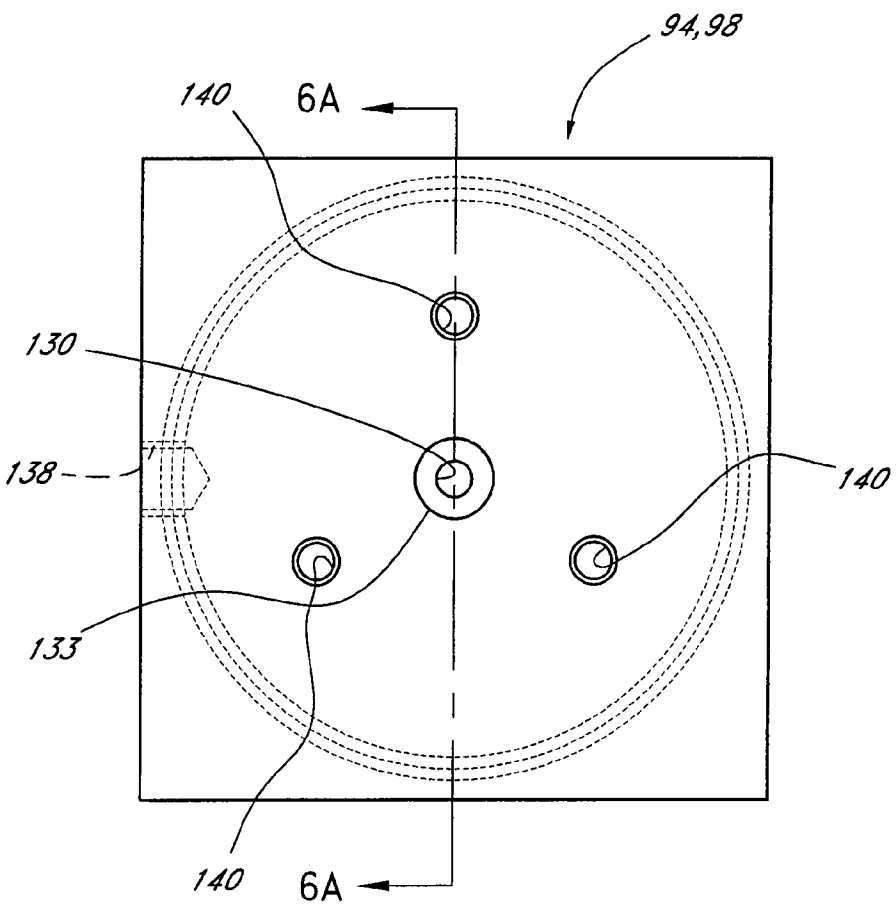
FIG. 6B is a top view of a cylinder in accordance with one embodiment, a bore is shown in dashed lines that extends from an exterior portion of the cylinder to within the cylinder.
Figure 6A:
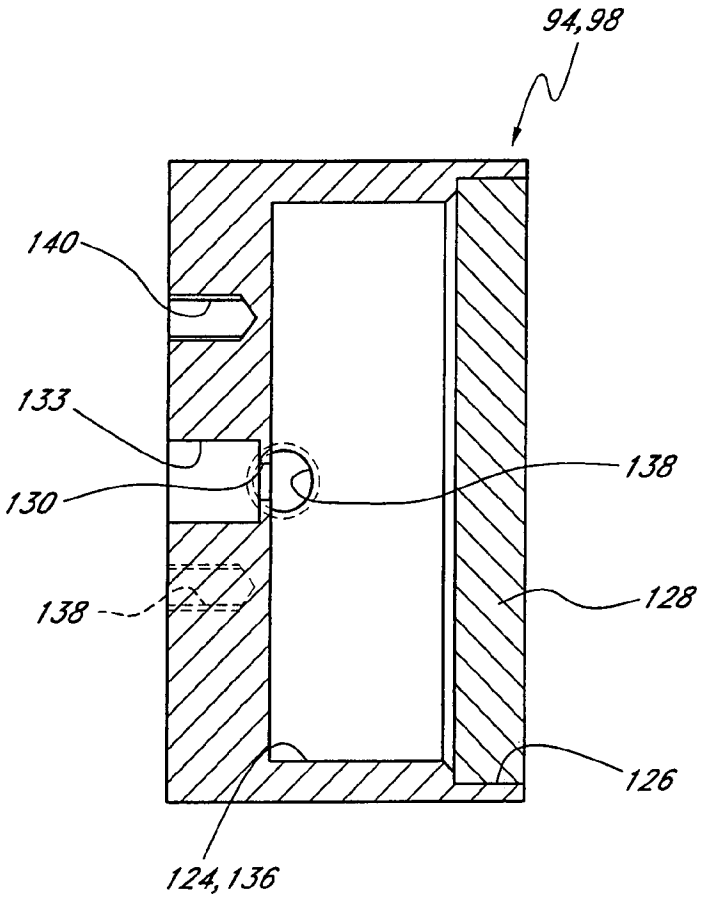
FIG. 6A is a cross-sectional view of a cylinder in accordance with one embodiment.

As shown in FIGS. 6A and 6B, the inflow portion cylinder 94 preferably includes an inflow cylinder chamber 124 and a base opening 126. The base opening 126 is configured to accommodate a base cylinder cover 128 that seals the inflow cylinder chamber 124. The inflow cylinder chamber 124 is preferably configured to accommodate the inflow portion piston 64.

In one embodiment, the inflow cylinder chamber 124 may have a diameter of about 2.993 inches. In some embodiments, the inflow cylinder chamber 124 may have a diameter between about one inch and about five inches. In other embodiments, the inflow cylinder chamber 124 may have a diameter significantly less than about one inch and greater than about five inches. The inflow cylinder chamber 124 preferably has a length that provides space in the event of wear.

In the event that the occluders 58, 60 or the seats 74, 76 deteriorate, the pistons 64, 70 may have a greater stroke length. To accommodate for this, the cylinder chamber 124 may provide space on either side of the pistons 64, 70 when in a minimum or maximum configuration. Such space will prevent the pistons 64, 70 from striking the top of the cylinder chamber 124 or the base cylinder cover 128. In one embodiment, about one inch may be provided on either side of the pistons' 64, 70 minimum or maximum configuration. In some embodiments, between about 0.5 inches and about 2 inches may be provided. In other embodiments, the space may be substantially less than about 0.5 inches or greater than about 2 inches.

With reference to FIG. 3, in one embodiment, the inflow portion piston 64 may have a diameter of about 2.980 inches. In some embodiments, the inflow portion piston 64 may have a diameter between about one inch and about five inches. In other embodiments, the inflow portion piston 64 may have a diameter that is significantly less than about one inch and greater than about five inches.

The pistons 64, 70 are configured to be movably displaced within the cylinders 94, 98. The pistons 64, 70 may comprise a channel 134 about the pistons' 64, 70 perimeter that permits placement of a piston seal 133 therein to prevent leakage of air between the cylinder chamber 124, 136 above the piston 64, 70 and below the piston 64, 70.

The pistons 64, 70 may be threadably attached to the respective rods 62, 68. While this may be accomplished in a number of ways, in one embodiment, a bolt may be threaded through an opening extending through the pistons 64, 70 such that it threadably engages a threaded bore at the end of the pistons 64, 70. Other methods of attachment may also be used to couple the pistons 64, 70 to the rods 62, 68.

Returning reference to FIGS. 6A and 6B, the inflow portion cylinder 94 preferably includes an opening 130 that extends from the top of the inflow portion cylinder 94 to the inflow cylinder chamber 124. The opening 130 is preferably sized and configured to permit placement of the rod 62 therethrough, and to accommodate placement therein of a rod bearing 131 (shown in FIG. 3). In one embodiment, the opening 130 may also accommodate the secondary seal 120 (also shown in FIG. 3).

The opening 130 may have a diameter of about 0.39 inches in one embodiment. In some embodiments, the opening 130 may have a diameter between about 0.3 inches to about 0.7 inches. In other embodiments, the opening 130 may have a diameter that is substantially less than about 0.3 inches and greater than about 0.7 inches.

In some embodiments, a bore 133 may extend along the opening 130 for placement therein of a rod bearing 131. In one embodiment, this bore 133 may have a diameter of about 0.5 inches. In some embodiments, the bore 133 may have a diameter of between about 0.3 inches and about 0.7 inches. In other embodiments, the bore 133 may have a diameter that is substantially less than about 0.3 inches and greater than about 0.7 inches.

As illustrated in FIGS. 6A and 6B, in one embodiment, the cylinders 94, 98 may include a passageway 138 that extends from the exterior of the cylinder to the cylinder chambers 124, 136. Preferably, passageway 138 provides fluid communication between the exterior of the cylinders 94, 98 and the cylinder chambers 124, 136 to permit introduction or evacuation of air, for example, therethrough.

The passageway 138 may have a diameter of about 0.125 inches in one embodiment. In some embodiments, the passageway 138 may have a diameter between about 0.1 inch and about 0.3 inches. In other embodiments, the passageway 138 may have a diameter that is substantially greater than about 0.3 inches and less than about 0.1 inches.

Passageway 138 is preferably configured to be connectable to an air compressor (not shown) or other fluid or gas regulator that will actuate the pistons 64, 70 according to the pump 44 position. When the carriage 78 of the pump 44 is moving down, fluid or gas is drawn into the top pump cylinder 42 through the first pump line 46 and is pumped out of the bottom pump cylinders 48 through the second pump line 50.

As shown in FIG. 1, while the carriage 78 is moving down, the servo motor or linear transducer 67 preferably directs the air compressor or other fluid or gas regulator to evacuate the inflow cylinder chamber 124 above the inflow portion piston 64, drawing the inflow portion piston 64 toward the top of the chamber 124. In this configuration, the inflow portion piston 64 moves the inflow occluder 58 to engage the top seat 74 and seals the conduit 56 connecting the inflow port 36 and the second pump port 40. This configuration permits the fluid to flow from the inflow port 36 to the first pump port 38 and through the first pump line 46 to the top pump cylinders 42.

Also while the carriage 78 of the pump 44 is moving down, the servo motor or linear transducer 67 preferably directs the air compressor or other fluid or gas regulator to pressurize the outflow cylinder chamber 136 above the outflow portion piston 70, moving the outflow portion piston 70 toward the base of the cylinder chamber 136. In this configuration, the outflow portion piston 70 moves the outflow occluder 60 to engage the bottom seat 76 and seals the conduit 56 connecting the outflow port 52 and the first pump port 38. This configuration permits fluid to flow from the bottom pump cylinders 48 to the outflow port 52 through the second pump line 50 and the second pump port 40.

When the carriage 78 reaches a predetermined or desired point in its downward stroke, the pump 44 reverses the movement of the carriage 78. When direction of the carriage 78 is reversed, flow in the first and second pump lines 46, 50 is also reversed. In this configuration, fluid is pumped from the top pump cylinder 42 through the first pump line 46, and fluid is supplied to the bottom pump cylinders 48 through the second pump line 50, as shown in FIG. 2.

Upon switching the direction of the carriage 78, the servo motor or linear transducer 67 preferably directs the air compressor or other fluid or gas regulator to pressurize the inflow cylinder chamber 124 above the inflow portion piston 64, moving the inflow portion piston 64 toward the base of the cylinder chamber 124. In this configuration, the inflow portion piston 64 moves the inflow occluder 58 to engage the bottom seat 76 and seals the conduit 56 connecting the inflow port 36 and the first pump port 38. Upon movement of the inflow occluder 58 toward the bottom seat 76, fluid communication between the inflow port 36 and the second pump port 40 is preferably permitted, as shown in FIG. 2. This configuration permits fluid entering the inflow port 36 to be directed to the second pump port 40. The fluid is thereupon supplied to the bottom pump cylinders 48 through the second pump line 50.

When the carriage 78 is moving upward, the servo motor or linear transducer 67 also preferably directs the air compressor or other fluid or gas regulator to evacuate the outflow cylinder chamber 136 above the outflow portion piston 70, moving the outflow portion piston 70 toward the top of the outflow cylinder chamber 136. In this configuration, the outflow portion piston 70 causes the outflow occluder 60 to engage the top seat 74 and seals the conduit 56 connecting the outflow port 52 and the second pump port 40. Upon movement of the outflow occluder 60 toward the top seat 74, fluid communication is provided between the outflow port 52 and the first pump port 38, as shown in FIG. 2. This configuration permits fluid to be pumped from the top pump cylinder 42 to the first pump port 38 through the first pump line 46. Upon entering the first pump port 38, the fluid is directed through the conduit 56 to the outflow port 52.

In one embodiment, the gas used to actuate the pistons 64, 70 may be air. However, various gases may be used in place of air for the purposes herein. In other embodiments, fluids may also be used. In yet further embodiments, the pistons 64, 70 may be actuated by other means. For example, the pistons 64, 70 may be operated by electro-magnets or other electric or electromechanical means.

Threaded bolt bores 140 (FIG. 3) are preferably provided to accommodate bolts, by which the various sections of the valve 30 are secured. Other ways of assembling the valve 30 may also be used. Between each section of the valve 30, there are preferably cylindrical channels 142, as shown in FIGS. 5A and 5B, that may permit placement therein of an o-ring to seal the internal conduit 56 and cylinder chambers 124, 136 from leaking fluid.

Preferably, the connections between the inflow line 34 and the inflow port 36 and between the outflow port 52 and the outflow line 54 are sealed to prevent leakage of fluid. The crossover switching valve 30 preferably includes sealing between each of the connections, portions, and sections to prevent leaking of the fluid within the valve. Many means may be used to accomplish the sealing, as are readily apparent to those of skill in the art. An o-ring placed in a channel between such connections is one example of how the sealing may be accomplished.

Although this crossover switching valve 30 has been disclosed in the context of certain preferred embodiments and examples, it will be understood by those skilled in the art that the valve 30 extends beyond the specifically disclosed embodiments to other alternative embodiments and/or uses of the valve 30 and obvious modifications and equivalents thereof. In addition, while a number of variations of the valve 30 have been shown and described in detail, other modifications, which are within the scope of this valve 30, will be readily apparent to those of skill in the art based upon this disclosure. It is also contemplated that various combinations or subcombinations of the specific features and aspects of the embodiments may be made and still fall within the scope of the valve 30. Accordingly, it should be understood that various features and aspects of the disclosed embodiments can be combined with or substituted for one another in order to form varying modes of the disclosed valve 30. Thus, it is intended that the scope of the valve 30 herein disclosed should not be limited by the particular disclosed embodiments described above, but should be determined only by a fair reading of the claims that follow.

What is claimed is:

1. A valve configured to provide continuous flow of a fluid comprising:

an inflow port configured to permit fluid to flow into the valve from a fluid source that is in fluid communication with the inflow port;

an outflow port configured to discharge fluid from the valve;

a first port configured to be in fluid communication with a first portion of a dual acting pump;

a second port configured to be in fluid communication with a second portion of the dual acting pump;

an internal conduit comprising a first and second passage, the internal conduit configured to provide fluid communication between the inflow port, the outflow port, the first port, and the second port;

first and second occluders configured to each have respectively, first and second seated positions within the internal conduit and to thereby control the fluid communication within the internal conduit, the first occluder configured to allow fluid communication between the inflow port and either the first port or the second port depending on its seated position and the second occluder configured to allow fluid communication between the outflow port and either the first port or the second port depending on its seated position; and first and second independently translatable rods, the first rod configured to linearly translate the first occluder between the first and second positions within the first passage, and the second rod configured to linearly translate the second occluder between the first and second positions within the second passage, said first passage having a first passage wall extending between said first and second seated positions of the first occluder, and said second passage having a second passage wall extending between the first and second seated positions of the second occluder, wherein as the first occluder moves within the first passage between the first and second seated positions there is a space between the first occluder and the first passage wall, and as the second occluder moves within the second passage between the first and second seated positions there is a space between the second occluder and the second passage wall;

wherein the valve is configured such that when the first and second occluders are in the first seated positions, the inflow port is in fluid communication with the first portion of the dual acting pump and the outflow port is in fluid communication with the second portion of the dual acting pump, and when the first and second occluders are in the second seated positions, the inflow port is in fluid communication with the second portion of the dual acting pump and the outflow port is in fluid communication with the first portion of the dual acting pump.

2. The valve of claim 1, wherein the first and second occluders are configured to be actuated by air pressure.

3. The valve of claim 1, wherein the inflow port is configured to be rotatable to permit various orientations of the inflow port.

4. The valve of claim 1, wherein the outflow port is configured to be rotatable to permit various orientations of the outflow port.

* * * * *

UNITED STATES PATENT AND TRADEMARK OFFICE

CERTIFICATE OF CORRECTION

PATENT NO. : 7,625,190 B2
APPLICATION NO. : 11/103272
DATED : December 1, 2009
INVENTOR(S) : Steve C. Smith It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 457 days.

Signed and Sealed this

Twenty-sixth Day of October, 2010

David J. Kappos

David J. Kappos
*Director of the United States Patent and Trademark Office*